US009004551B2

(12) United States Patent
Browne et al.

(10) Patent No.: US 9,004,551 B2
(45) Date of Patent: Apr. 14, 2015

(54) LATCHABLE OR LOCKABLE DEVICE

(75) Inventors: Alan L. Browne, Grosse Pointe, MI (US); Geoffrey P. McKnight, Los Angeles, CA (US); Guillermo A. Herrera, Winnetka, CA (US)

(73) Assignee: GM Global Technology Operations LLC, Detroit, MI (US)

( * ) Notice: Subject to any disclaimer, the term of this patent is extended or adjusted under 35 U.S.C. 154(b) by 233 days.

(21) Appl. No.: 13/584,035

(22) Filed: Aug. 13, 2012

(65) Prior Publication Data

US 2014/0042756 A1 Feb. 13, 2014

(51) Int. Cl.

| | |
|---|---|
| ***E05C 17/56*** | (2006.01) |
| ***E05B 47/00*** | (2006.01) |
| *E05C 19/16* | (2006.01) |

(52) U.S. Cl.

CPC ..... *E05C 19/16* (2013.01); *E05B 47/0002* (2013.01); *E05B 47/0038* (2013.01); *E05B 2047/0033* (2013.01); *E05B 2047/0073* (2013.01); *E05B 2047/0076* (2013.01)

(58) Field of Classification Search

USPC ..... 292/1, 251.5; 188/267.2

See application file for complete search history.

(56) References Cited

U.S. PATENT DOCUMENTS

| | | | | |
|---|---|---|---|---|
| 3,794,366 | A * | 2/1974 | Graham | 292/144 |
| 4,886,295 | A * | 12/1989 | Browne | 280/777 |
| 5,284,330 | A * | 2/1994 | Carlson et al. | 267/140.14 |
| 5,868,445 | A * | 2/1999 | Kaufman et al. | 292/251.5 |
| 5,984,385 | A * | 11/1999 | Shtarkman et al. | 292/251.5 |
| 6,318,521 | B1 * | 11/2001 | Niaura et al. | 188/267.1 |
| 6,382,369 | B1 * | 5/2002 | Lisenker | 188/267.2 |
| 6,394,239 | B1 * | 5/2002 | Carlson | 188/267.2 |
| 6,464,051 | B2 * | 10/2002 | Lisenker et al. | 188/267.2 |
| 6,514,001 | B1 * | 2/2003 | Yezersky et al. | 403/109.1 |
| 6,610,404 | B2 * | 8/2003 | Starkovich et al. | 428/402 |
| 6,712,409 | B2 * | 3/2004 | Monig | 292/336.3 |
| 6,964,324 | B2 * | 11/2005 | Shimada et al. | 188/267.2 |
| 7,097,212 | B2 * | 8/2006 | Willats et al. | 292/1 |
| 7,331,616 | B2 * | 2/2008 | Brei et al. | 292/100 |
| 8,651,250 | B2 * | 2/2014 | Nehl et al. | 188/267 |
| 2005/0199455 | A1 * | 9/2005 | Browne et al. | 188/266.4 |
| 2005/0230195 | A1 * | 10/2005 | Jones et al. | 188/68 |
| 2005/0263359 | A1 * | 12/2005 | Mankame et al. | 188/266.1 |
| 2008/0141736 | A1 * | 6/2008 | Jones et al. | 70/77 |

* cited by examiner

*Primary Examiner* — Carlos Lugo

(74) *Attorney, Agent, or Firm* — Cantor Colburn LLP

(57) ABSTRACT

A lockable or latchable device includes first and second members proximate to each other, at least one of which is movable with respect to the other. The device also includes a magnetorheological fluid disposed in the device such that the fluid is in simultaneous contact with at least a portion of each of the first and second members when the first and second members are in a position for locking or latching. A permanent magnet is disposed in the device to inhibit displacement of the magnetorheological fluid when the first and second members are in the locked or latched position. An electromagnet is disposed in the device such that magnetic flux from the electromagnet, when activated, disrupts the magnetic flux of the permanent magnet when the first and second members are in the locked or latched position to unlatch or unlock the device.

18 Claims, 2 Drawing Sheets

LATCHABLE OR LOCKABLE DEVICE

FIELD OF THE INVENTION

Exemplary embodiments of the present invention are related to latchable or lockable devices and, more specifically, to latchable or lockable devices that utilize a magnetorheological fluid.

BACKGROUND

Latchable or lockable devices are widely used for a variety of purposes, including but not limited to door latches and locks, vehicle hood and trunk latches and locks, and various configurations of rotating shafts with locking mechanisms for preventing rotation. All different types and manner of configurations are known. Many latching and/or locking mechanisms rely on physical interference between components of the mechanism to inhibit movement, thereby providing a locked or latched state. Such mechanisms can be subject to wear and tear from such mechanical interference, which can lead to breakage or other failure modes for the mechanism. Additionally, added degrees of mechanical complexity may be required for actuation of the mechanism (i.e., transition from locked to unlocked, and vice versa), which can cause further problems with respect to cost and reliability. It is often desirable to electronically control latching/locking mechanisms for remote access control, however, the electromechanical configurations required for such control can lead to additional cost and reliability problems.

Electromagnetic latches and locks have been used as alternatives to conventional mechanical latches and locks. While such electromagnetic devices may allow for simpler designs with fewer moving parts, magnetic force alone may not provide sufficient hold strength for many applications. Additionally, electromagnetic latches and locks typically require continuous application of electrical current in order to maintain the mechanism in its latched or locked state.

In view of the above, many alternative latching and locking mechanisms have been used over the years; however, new and different alternatives are always well received that might be more appropriate for or function better in certain environments or could be less costly or more durable or otherwise provide added functionality.

SUMMARY OF THE INVENTION

In one exemplary embodiment, a lockable or latchable device comprises first and second members proximate to each other, at least one which is movable with respect to the other. The device also includes a magnetorheological fluid disposed in the device such that the fluid is in simultaneous contact with at least a portion of each of the first and second members when the first and second members are in a position for locking or latching. A permanent magnet is disposed in the device such that magnetic flux from the permanent magnet inhibits flow (i.e., internal shearing) of the magnetorheological fluid when the first and second members are in the locked or latched position, thereby preventing movement of the first and second members with respect to each other. An electromagnet is disposed in the device such that magnetic flux from the electromagnet, when activated, disrupts the magnetic flux of the permanent magnet when the first and second members are in the locked or latched position, thereby allowing movement of the first and second members with respect to each other while the electromagnet is activated.

In another exemplary embodiment, a lockable rotational device comprises a cylindrical housing and a cylindrical shaft disposed within the cylindrical housing, the shaft and housing being rotationally movable with respect to each other and defining an annular space between the shaft and the housing, with a magnetorheological fluid disposed in the annular space. A permanent magnet or permanent magnet assembly is disposed in the device such that magnetic flux from the permanent magnet inhibits shearing of the magnetorheological fluid, thereby preventing rotation of the housing and the shaft with respect to each other. An electromagnet is disposed in the device such that magnetic flux from the electromagnet, when activated, disrupts the magnetic flux of the permanent magnet, thereby allowing movement of first and second members with respect to each other while the electromagnet is activated.

The above features and advantages, and other features and advantages of the invention are readily apparent from the following detailed description of the invention when taken in connection with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DESCRIPTION OF THE EMBODIMENTS

Figure 1:
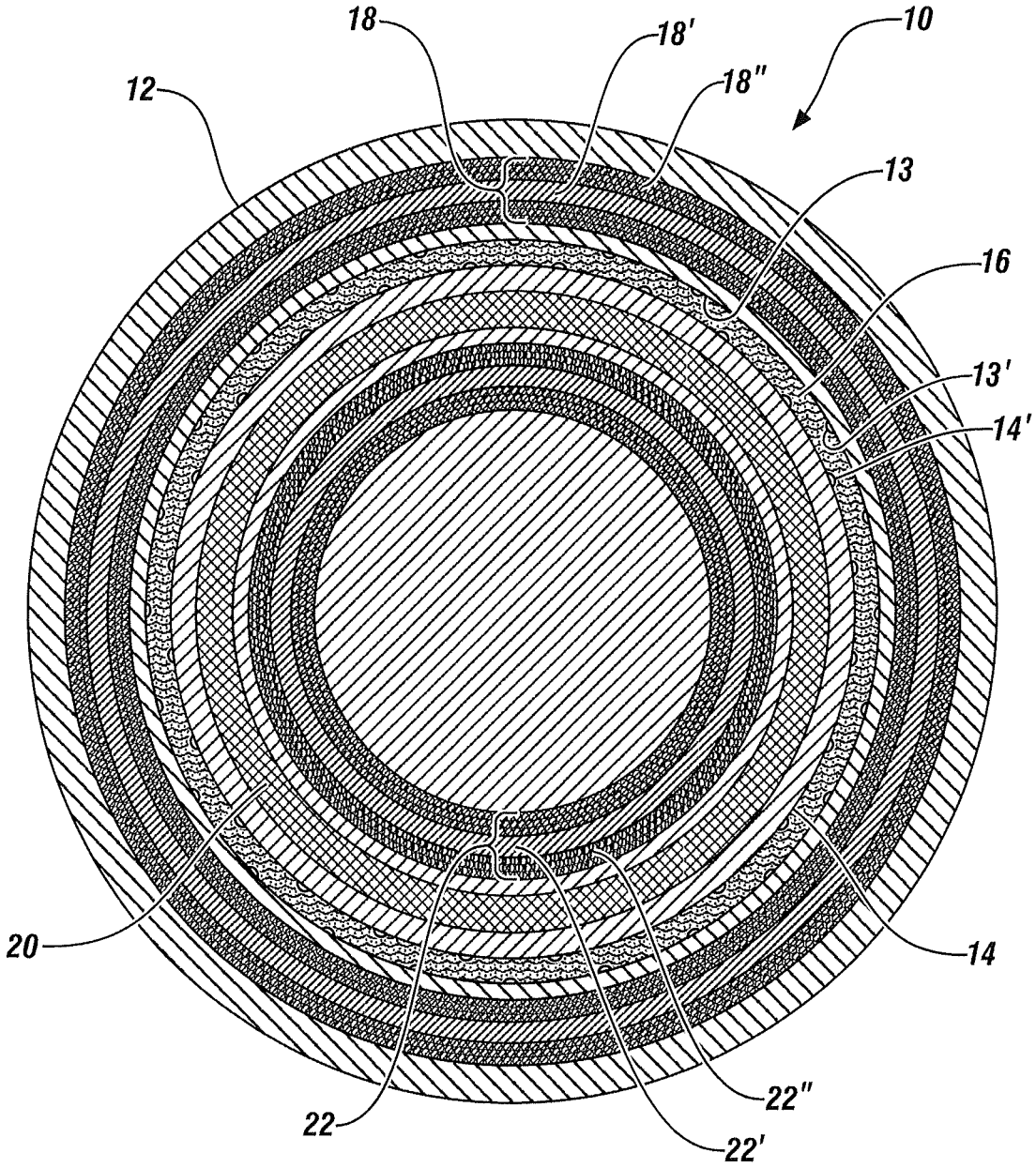
FIG. 1 depicts a cross-sectional schematic diagram of an exemplary rotational latchable or lockable device.

The following description is merely exemplary in nature and is not intended to limit the present disclosure, its application or uses. It should be understood that throughout the drawings, corresponding reference numerals indicate like or corresponding parts and features.

Turning now to the Figures, FIG. 1 illustrates a cross-sectional schematic diagram of an exemplary rotational latchable or lockable device. The rotational device 10 includes housing 12 having a rotatable shaft 14 disposed therein. An annular space between the rotatable shaft 14 and the inner surface 13 of the housing 12 has a magnetorheological (or "MR") fluid 16 disposed therein. In an exemplary embodiment, the thickness of the annular space occupied by the magnetorheological fluid 16 is between 0.01 mm and 2.0 mm, which enables the fluid to be magnetically activated from a low shear stress state to a high shear stress state. An electromagnet 18 (having a core 18' and windings 18") can be disposed in the housing 12. A permanent magnet 20 is disposed in the rotatable shaft 14, and an electromagnet 22 (having a core 22' and windings 22") can be disposed within the rotatable shaft 14 and located concentrically within the permanent magnet 20. It should be noted that the coil-shaped depiction of the electromagnets 18 and 22 are schematic in nature, and not intended to depict actual dimensions and positioning of core and winding components of the electromagnets. In practice, electromagnets 18 and 22 would be oriented perpendicular to the intended magnetic field direction to provide targeted interference with the magnetic field produced by permanent magnet 20, as described in more detail below. In operation, the device can be maintained in a locked or latched state without the application of any power, as magnetic flux from the permanent magnet 20 will maintain the magnetorheological fluid 16 in an activated high shear modulus state. In this activated state, the magnetorheological fluid will behave similar to a solid material, thereby preventing rotation of the rotatable shaft 14 with respect to the housing 12. To unlatch or unlock the device, power is supplied to the electromagnet such as in location 22. The activated electromagnet 18 or 22 generates magnetic flux to interfere with the magnetic flux generated by permanent magnet 20, thus causing the magnetorheological fluid 16 to revert to its unactivated state with a lower shear modulus. Note that only one of the electromagnets 18 or 22 may be sufficient, making the other electromagnet optional. The unactivated magnetorheological fluid 16 behaves as a fluid, allowing rotation of the rotatable shaft 14 with respect to the housing 12. After the rotatable shaft 14 has rotated to another desired latching/locking position, power to the electromagnet (either in location 18 or 22) can be terminated, causing the device to be latched/locked. Although it is often unnecessary, in an exemplary embodiment, either or both of the surfaces of the inner surface 13 of the housing or the surface of the rotatable shaft 14 in contact with the magnetorheological fluid can have protuberances 13', 14' thereon (typically on the order of 1 mm in height) to assist in maintaining the device in a latched or locked state or to provide some degree of resistance to rotation in the unlatched or unlocked state.

Figure 2A:
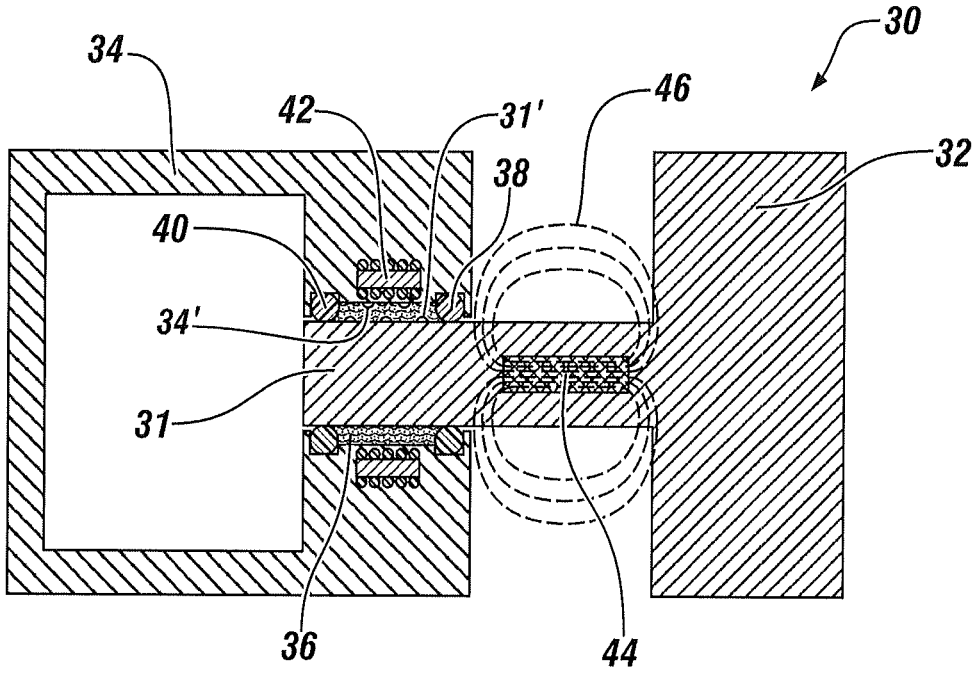
FIGS. 2A-2B depict a side-view cross-sectional schematic diagram of an exemplary latchable or lockable device in varying degrees of latching/locking engagement.
Figure 2B:
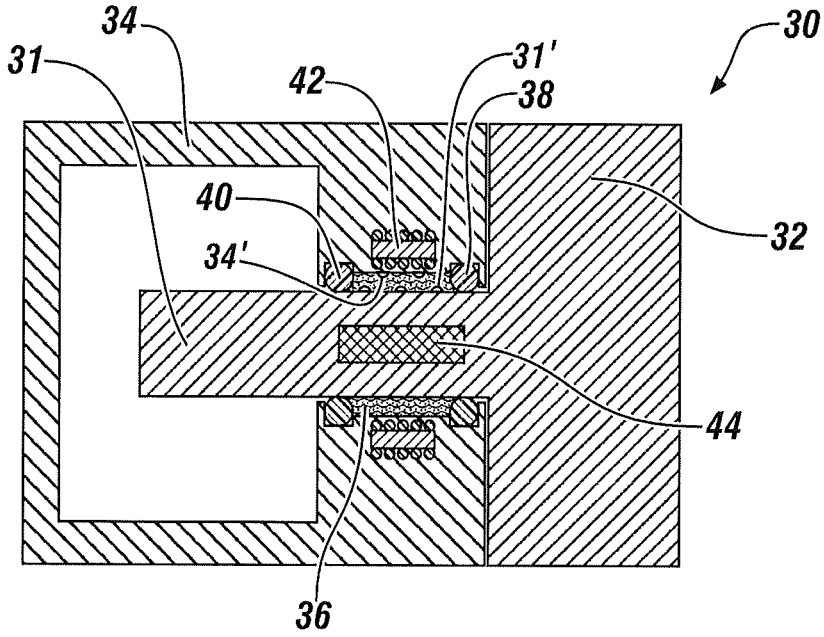

Turning now to FIGS. 2A and 2B, there is shown a cross-sectional schematic diagram of an exemplary lockable or latchable device 30. FIGS. 2A and 2B show a latching or lockable device having two members: a receiving member body 34 and an engaging member 32. Receiving member 34 has a cylindrical opening that surrounds rod portion 31 of the engaging member 32, with a thin layer of magnetorheological fluid 36 therebetween. The magnetorheological fluid 36 held in place by seals 38 and 40. Engaging member 32 has a permanent magnet 44 embedded in the rod portion 31. Permanent magnet 44 is shown in FIG. 2A with magnetic flux lines extending therefrom, with a portion of magnetic flux lines 46 extending in a direction that is substantially perpendicular to the laminar thickness of layer of magnetorheological fluid 36. Magnetic flux is of course present in the embodiment depicted in FIG. 2B, but is not shown for ease of illustration. Receiving member 34 has an electromagnet 42 embedded therein that surrounds the rod portion 31 of the engaging member 32.

FIGS. 2A-2B illustrate the device in operation. In FIG. 2A, the device is illustrated in an unlatched position. With the electromagnet in an unpowered state, the shear modulus of the magnetorheological fluid 36 is low, and the rod portion 31 can be freely moved within the receiving member 34. In FIG. 2B, the rod portion 31 has moved into a position where the magnetic flux lines 46 from the permanent magnet 44 causes a significant increase in the shear modulus of the magnetorheological fluid 36 (it should be noted that the depiction of the magnetic flux lines 46 in FIG. 2A is conceptual in nature and the figures are not necessarily intended to represent with precision an exact position of the permanent magnet 44 where its magnetic flux lines would cause a significant increase of MR fluid shear modulus). This increase in shear modulus causes the magnetorheological fluid 36 to behave similar to a solid material, thereby immobilizing the rod portion 31 of the engaging member 32 so that the device is in a locked or latched position.

To unlatch the device from the latched/locked position shown in FIG. 2B, power is supplied to the electromagnet 42. The activated electromagnet 42 generates magnetic flux to interfere with the magnetic flux generated by permanent magnet 44 (if the coils are wound in the radial direction with respect to the rod portion 31 of the engaging member 32), thus causing the magnetorheological fluid 36 to revert to its unactivated state with a lower shear modulus, or to overcome the magnetic flux generated by permanent magnet 44 and reorient the high shear stiffness direction of the MR fluid in the axial direction (if the coils are wound in the axial direction with respect to the rod portion 31 of the engaging member 32), either of which would have the effect of allowing movement of the rod portion 31. The low-shear magnetorheological fluid 36 can be displaced by movement of the rod portion 31, allowing the engaging member 32 to be moved out of the latched/locked position back to the separated unlatched positions shown in FIG. 2A. After the engaging member 32 has moved out of the latched/locked position, power to the electromagnet 42 can be terminated. The device can therefore be maintained indefinitely in either the latched/locked or the unlatched/unlocked state without having to provide power to the electromagnet; power being needed only to transition between the latched/locked and the unlatched/unlocked states.

It should be noted that although FIG. 2B shows a singular latched or locked position, the engaging member 32 can be stopped at any position by deactivating the electromagnet 42 along the engaging member's axial path where the permanent magnet 44 is in position to provide magnetic flux for increasing the shear modulus of the magnetorheological fluid 36. In other exemplary embodiments, the engaging member 32 can have a plurality of permanent magnets or electromagnets (not shown) disposed at a plurality of locations to provide desired magnetic flux patterns. Also, similarly to the rotational device of FIG. 1, the surfaces of the rod 31 and/or the receiving member 34 can have protuberances 31', 34' to assist in maintaining the device in a latched or locked state or to provide some degree of resistance to rotation in the unlatched or unlocked state.

Magnetorheological fluids are well-known in the art, and generally comprise magnetic particles dispersed within a liquid carrier. Magnetic particles suitable for use in the magnetorheological fluids are magnetizable, low coercivity (i.e., little or no residual magnetism when the magnetic field is removed), finely divided particles of iron, nickel, cobalt, iron-nickel alloys, iron-cobalt alloys, iron-silicon alloys and the like which may be spherical or nearly spherical in shape and have a diameter in the range of about 0.1 to 100 microns. Since the particles may be employed in noncolloidal suspensions, they can in an exemplary embodiment be at the small end of the suitable range, for example in the range of 1 to 10 μm in nominal diameter or particle size.

A suitable magnetizable solid for the magnetic particles may include CM carbonyl iron powder and HS carbonyl iron powder, both commercially available. The carbonyl iron powders are gray, finely divided powders made of highly pure metallic iron. The carbonyl iron powders are produced by thermal decomposition of iron pentacarbonyl, a liquid which has been highly purified by distillation. The spherical particles include carbon, nitrogen and oxygen. These elements provide the particles a core/shell structure with high mechanical hardness. CM carbonyl iron powder includes more than 99.5 wt % iron, less than 0.05 wt % carbon, about 0.2 wt % oxygen, and less than 0.01 wt % nitrogen, with a particle size distribution of less than 10% at 4.0 μm, less than 50% at 9.0 μm, and less than 90% at 22.0 μm, with true density >7.8 g/cm3. The HS carbonyl iron powder includes minimum 97.3 wt % iron, maximum 1.0 wt % carbon, maximum 0.5 wt % oxygen, maximum 1.0 wt % nitrogen, with a particle size distribution of less than 10% at 1.5 μm, less than 50% at 2.5 μm, and less than 90% at 3.5 μm. As indicated, the weight ratio of CM to HS carbonyl powder may range from 3:1 to 1:1, more specifically about 1:1.

Examples of other iron alloys that may be used as magnetic particles include iron-cobalt and iron-nickel alloys. Iron-cobalt alloys can have an iron-cobalt ratio ranging from about 30:70 to about 95:5, more specifically from about 50:50 to about 85:15, while the iron-nickel alloys have an iron-nickel ratio ranging from about 90:10 to about 99:1, more specifically from about 94:6 to 97:3. The iron alloys can also include a small amount of other elements such as vanadium, chromium, etc., in order to provide ductility and mechanical properties of the alloys. These other elements are typically present in amounts less than about 3.0 percent total by weight.

The magnetic particles can be in the form of metal powders. The particle size of magnetic particles can exhibit bimodal characteristics when subjected to a magnetic field. Average particle diameter distribution size of the magnetic particles is generally between about 1 and about 100 microns, more specifically between about 1 and about 50 microns. The magnetic particles can be present in bimodal distributions of large particles and small particles with large particles having an average particle size distribution between about 5 and about 30 microns. Small particles can have an average particle size distribution between about 1 and about 10 microns. In the bimodal distributions as disclosed herein, it is contemplated that the average particle size distribution for the large particles will typically exceed the average particle size distribution for the small particles in a given bimodal distribution. Thus, in situations where the average particle distribution size for large particles is 5 microns, for example, the average particle size distribution for small particles will be below that value.

The magnetic particles can be spherical in shape. However, it is also contemplated that magnetic particles can have irregular or nonspherical shapes as desired or required. Additionally, a particle distribution of nonspherical particles as disclosed herein can have some spherical or nearly spherical particles within its distribution. Where carbonyl iron powder is employed, a significant portion of the magnetic particles can have a spherical or near spherical shape.

In an exemplary embodiment, the magnetic particles can have a coating thereon that has hydrophobic groups, e.g., a silicate coating. The coating with a hydrophobic group can provide reduced the viscosity and zero field yield stress of the magnetorheological fluid, and also inhibit oxidation of iron particles. In an exemplary embodiment, the coating is octyltriethoxysilane, which can provide reduced off-state viscosity and yield stress. When present, the coating can be present in an amount of about 0.01 to about 0.1 wt. % of the total weight of the particle(s).

The magnetic particles are dispersed into a suitable carrier liquid. Suitable carrier liquids can suspend the magnetic particles but are essentially nonreactive with them. The carrier liquid can include at least one of water, or organic liquids such as alcohol, a glycol or polyol, silicone oil or hydrocarbon oil. Examples of suitable alcohols include, but are not limited to, heptanol, benzyl alcohol, ethylene glycol and/or polypropylene glycol. Examples of suitable hydrocarbon oils include, but are not limited to, polyalpha-olefins (PAO, mineral oils and/or polydimethylsiloxanes). Examples of organic and/or oil based carrier liquids include, but are not limited to, cyclo-paraffin oils, paraffin oils, natural fatty oils, mineral oils, polyphenol ethers, dibasic acid esters, neopentylpolyol esters, phosphate esters, polyesters, synthetic cyclo-paraffin oils and synthetic paraffin oils, unsaturated hydrocarbon oils, monobasic acid esters, glycol esters and ethers, silicate esters, silicone oils, silicone copolymers, synthetic hydrocarbon oils, perfluorinated polyethers and esters, halogenated hydrocarbons, and mixtures or blends thereof. Hydrocarbon oils, such as mineral oils, paraffin oils, cyclo-paraffin oils (also as napthenic oils), and synthetic hydrocarbon oils may be employed as carrier liquids. Synthetic hydrocarbon oils include those oils derived from the oligomerization of olefins such as polybutenes and oils derived from higher alpha olefins of from 8 to 20 carbon atoms by acid catalyzed dimerization, and by oligomerization using trialuminum alkyls as catalysts. In another exemplary embodiment, the oil may be derived from vegetable materials. The oil of choice may be one amenable to recycling and reprocessing as desired or required.

Another suitable commercially available carrier liquid is a hydrogenated polyalphaolefin (PAO) base fluid. The material is a homopolymer of 1-decene, which is hydrogenated. It is a paraffin-type hydrocarbon and has a specific gravity of 0.82 at 15.6° C. It is a colorless, odorless liquid with a boiling point ranging from 375° C. to 505° C., and a pour point of −57° C.

The magnetic particles can be present in the magnetorheological fluid at about 10 to 60 percent by volume and the carrier liquid can may be present in about 40 to 90 percent by volume. The magnetorheological fluid can also include various additives such as surfactants, antioxidants, suspending agents, and the like. Fumed silica is a suspending agent added in an amount of about 0.05 to 0.5 wt. %, more specifically 0.5 to 0.1 wt. %, and even more specifically from about 0.05 to 0.06 wt. %, based on the weight of the magnetorheological fluid. The fumed silica can be a high purity silica made from high temperature hydrolysis having a surface area in the range of 100 to 300 square meters per gram. In an exemplary embodiment, the magnetorheological fluid can include 10 to 14 wt. % of a polyalphaolefin liquid, 86 to 90 wt. % of magnetizable particles, optionally up to 0.5 wt. % fumed silica, and optionally up to 5 wt. % (of the liquid mass) of a liquid phase additive.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the present application. The terms "front", "back", "bottom", "top", "first", "second", "third" are used herein merely for convenience of description, and are not limited to any one position or spatial orientation or priority or order of occurrence, unless otherwise noted.

The invention claimed is:

1. A lockable or latchable device, comprising:

first and second members proximate to each other, at least one of said first and second members being movable with respect to the other;

a magnetorheological fluid disposed in the device such that the fluid is in simultaneous contact with at least a portion of each of the first and second members when the first and second members are in a position for locking or latching;

a permanent magnet disposed in the device such that magnetic flux from the permanent magnet inhibits shear of the magnetorheological fluid when the first and second members are in the locked or latched position, thereby preventing movement of the first and second members with respect to each other; and an electromagnet disposed in the device such that magnetic flux from the electromagnet, when activated, disrupts the magnetic flux of the permanent magnet when the first and second members are in the locked or latched position, thereby allowing movement of the first and second members with respect to each other while the electromagnet is activated;

wherein portions of the first and second members are in simultaneous contact with the magnetorheological fluid in a slidable engagement with the magnetorheological fluid.

2. The device of claim 1, wherein either or both of the first and second members has one or more protuberances thereon positioned to be in contact with the magnetorheological fluid when the first and second members are in the locked or latched position.

3. The device of claim 1, comprising a plurality of permanent magnets.

4. The device of claim 3, comprising a plurality of electromagnets.

5. The device of claim 3, wherein the plurality of permanent magnets provide a plurality of locked or latched positions of the first and second members with respect to each other.

6. The device of claim 1, comprising a plurality of electromagnets.

7. The device of claim 1, wherein the first and second members together form an enclosure in which the magnetorheological fluid is contained.

8. The device of claim 1, wherein the first member includes a deformable membrane that retains the magnetorheological fluid, said membrane positioned to be in contact with the second member when the first and second members are in the locked or latched position.

9. A method of using the device of claim 1, comprising applying current to the electromagnet to create a magnetic flux that interferes with the magnetic flux generated by the permanent magnet, thereby permitting relative movement between the first and second members.

10. The method of claim 9, further comprising terminating the current applied to the electromagnet, thereby preventing relative movement between the first and second members.

11. A lockable rotational device, comprising:

a cylindrical housing disposed around a shaft, the housing and the shaft being rotatable with respect to each other, and defining an annular space between the shaft and the housing;

a magnetorheological fluid disposed in the annular space;

a permanent magnet disposed in the device such that the magnetic flux from the permanent magnet inhibits displacement of the magnetorheological fluid, thereby preventing rotation of the housing and the shaft with respect to each other; and an electromagnet disposed in the device such that magnetic flux from the electromagnet, when activated, disrupts the magnetic flux of the permanent magnet, thereby allowing movement of first and second members with respect to each other while the electromagnet is activated;

wherein portions of the first and second members are in simultaneous contact with the magnetorheological fluid in a slidable engagement with the magnetorheological fluid.

12. The device of claim 11, wherein the shaft includes one or more protuberances on its outer surface to assist in maintaining the device in a latched or locked state or to provide some degree of resistance to rotation in the unlatched or unlocked state.

13. The device of claim 11, wherein the housing includes one or more protuberances on its inner surface to assist in maintaining the device in a latched or locked state or to provide some degree of resistance to rotation in the unlatched or unlocked state.

14. The device of claim 11, wherein the housing comprises a housing outer shell and a housing inner shell, defining a housing annular space therebetween, and the electromagnet is disposed in the housing annular space.

15. The device of claim 14, wherein the permanent magnet is disposed in or on the shaft.

16. The device of claim 15, further comprising a second electromagnet disposed in the shaft between the electromagnet and the second electromagnet such that magnetic flux from the second electromagnet, when activated, also disrupts the magnetic flux of the permanent magnet, thereby allowing movement of first and second members with respect to each other while the second electromagnet is activated.

17. The device of claim 14, comprising a plurality of magnets, a plurality of electromagnets, or a plurality of magnets and electromagnets, disposed at intervals circumferentially around the axis of the shaft and housing.

18. The device of claim 17, wherein the plurality of magnets, plurality of electromagnets, or plurality of magnets and electromagnets, cooperate to provide a plurality of latched or locked positions of the shaft and housing with respect to each other.

* * * * *